United States Patent [19]

Beaumont et al.

[11] 4,076,629

[45] Feb. 28, 1978

[54] SOLVENT SOLUBLE WARP SIZE

[75] Inventors: Gerald P. Beaumont; William C. Jones, both of Midland, Mich.

[73] Assignee: The Dow Chemical Company, Midland, Mich.

[21] Appl. No.: 691,130

[22] Filed: May 28, 1976

[51] Int. Cl.[2] ..... D06M 15/26; D06M 15/32; C08F 112/08; C08F 114/02

[52] U.S. Cl. ..... 252/8.6; 8/94 A; 8/115.6; 8/138; 260/33.8 UA; 428/394

[58] Field of Search ..... 8/94 A, 115.6, 138; 260/33.8 UA; 252/8.6; 428/394

[56] References Cited

U.S. PATENT DOCUMENTS

| | | | |
|---|---|---|---|
| 2,978,362 | 4/1961 | Pritchard | 428/262 |
| 3,228,791 | 1/1966 | Armour et al. | 428/394 |
| 3,476,504 | 11/1969 | Case et al. | 8/138 |
| 3,879,334 | 4/1975 | Vredenburgh et al. | 260/33.6 UA |

*Primary Examiner*—John Kight, III
*Attorney, Agent, or Firm*—Glwynn R. Baker

[57] ABSTRACT

In the sizing of textile yarns with a chlorinated solvent solution of a low crystallinity chlorinated polyolefin, undesirable tackiness of the resin size is avoided by combining the chlorinated resin with a minor proportion of a high molecular weight aromatic hydrocarbon polymer such as polystyrene. The sizing resin mixture can be recovered for reuse from a solvent desizing process.

10 Claims, No Drawings

SOLVENT SOLUBLE WARP SIZE

BACKGROUND OF THE INVENTION

The present invention is an improvement in the known process whereby a textile material is sized by impregnating it with a solvent solution of a resinous sizing material. The invention also relates to an improved sizing resin composition and to the textile yarns sized with it.

Most commercial sizing of textile yarns is done at present with aqueous solutions or dispersions of substances such as starch, gelatin, casein, or water-soluble or dispersible polymers, for example, polyvinyl alcohol, cellulosic polymers, and other such organic polymers. Aqueous systems such as these have a number of disadvantages including sensitivity of the sized yarns to humidity, high energy requirements, and the problem of disposal of a contaminated waste water stream from the desizing process after weaving.

It is also known to size yarns with a chlorinated solvent solution of a soluble polymer such as a chlorinated polyolefin of which chlorinated polyethylene, chlorinated ethylene-propylene copolymer, copolymers of vinyl chloride and vinylidene chloride, polyvinyl chloride, and chlorinated rubber are examples. Such processes are described by Pritchard, U.S. Pat. Nos. 2,978,362; by Armour et al., 3,228,791; and by Case et al., 3,476,504. However, when these polymers are of low crystallinity as they typically are, the sized yarns tend to be tacky and cause problems in weaving because the yarns stick to one another and exhibit high friction with respect to parts of the weaving apparatus resulting in deterioration of fiber lay-down and warp breaks.

SUMMARY OF THE INVENTION

The problem of tackiness in textile yarns sized by the above-described chlorinated solvent solution process has now been found to be largely avoided by an improvement wherein the chlorinated polyolefin is combined with a minor proportion of a high molecular weight polymer of an aromatic hydrocarbon. Treatment of a textile yarn with a solvent solution of this resin blend produces a sized yarn with a non-tacky surface and excellent weaving performance as measured by low levels of shedding, warp stops, and yarn entanglement.

DETAILED DESCRIPTION OF THE INVENTION

The proportions of the components of the new resin sizing composition are preferably in the range of about 10 to 50 percent of high molecular weight aromatic hydrocarbon polymer based on the weight of chlorinated polyolefin and a proportion of about 20 to 40 percent hydrocarbon polymer usually gives the best results. The resin mixture is applied as a solution, usually of about 4 to 8 percent concentration, in a chlorinated lower aliphatic hydrocarbon solvent of the type commonly used as dry cleaning or metal cleaning solvents. Examples of the class are 1,1,1-trichloroethane, trichloroethylene, and perchloroethylene. These are ordinarily referred to merely as chlorinated solvents.

A principal advantage of the solvent solution sizing process is that both the solvent and the resin size can be recovered for recycle in the process. The resin size is readily removed from the woven fabric by a solvent wash and rinse. Resin size solution and excess solvent are recoverable from the desizing process by conventional means so that the whole sizing and desizing operation has minimal economic and waste disposal problems from loss of chemicals.

The main component of the resin size composition is a chlorinated polyolefin, this term referring herein to polymerized olefins of 2–4 carbon atoms which are later reacted with chlorine, to polymers of chloroolefins, and to copolymers and mixtures of both of these. Thus, the term includes chlorinated polyethylene, chlorinated polypropylene, chlorinated ethylene-propylene copolymer, chlorinated rubber, polyvinyl chloride, vinyl chloride-vinylidene chloride copolymers, and other such chlorine-containing polyolefins and mixtures thereof. The chlorine-containing polyolefins of low crystallinity, i.e., less than about 10 percent, and solubility of at least about 5 percent by weight in the chlorinated solvent of choice are those useful in the present invention. Low crystallinity chlorinated polyethylene of about 30 to 55 percent chlorine content is a preferred resin.

The preferred aromatic hydrocarbon polymer is polystyrene having an average molecular weight above about 100,000. Other operable resins of this class include polyvinyltoluene, poly-tert-butylstyrene, polyindene, and copolymers and mixtures of these.

The sizing process is applicable to all commonly used textile fibers including cotton, polyester, wool, linen, regenerated cellulose, nylon, polypropylene, acrylic fibers, acetate rayon, and blends thereof. While the sizing process may most commonly be applied to textile yarns prior to weaving, it may also be applied to webs or sheets, woven, nonwoven, or knitted.

TESTING PROCEDURE

The effectiveness and the practical operability of the sizing resin blend were determined in several ways, i.e., by taking measurements of the force required to unwind a spool of the sized and dried yarn, by observing the percent of entanglement, measured on the device described below and by observing the number of warp stops necessitated by breaks and entanglement, and the amount of shedding of size any yarn fibers during actual weaving tests on a commercial loom.

The effectiveness of the sizing is determined in the following examples with an entanglement tester for the yarns. The testing device is designed to copy the shedding action of a loom. The yarns are passed through heddles and then clamped under 44 grams tension. The machine is cycled at 100 picks per minute and the amount of yarn entangled is measured at 5, 10, 20 and 40 minutes of operation.

The entanglement tester accommodates 39 ends which are clamped at 46½ inches of length and ½ inch in width. There are spacers 0.010 inch thick to maintain even spacing of yarn. Weights are used on one end of the yarn to obtain the correct tension until the yarn is clamped in place. The shed height is 3¾ inches. During the shedding motion, the yarn is stretched 0.32 percent.

Data are obtained by stopping the drive and measuring the quantity of yarn entangled. To compensate for random entanglement, the length and number of ends entangled are measured at six consecutive positions of the machine at maximum shed height. The first ¾ inch of yarn is not measured because the yarns are so close that entanglement cannot be judged. The total entanglement is then calculated by summing the products of the ends multiplied by the inches entangled at each position and then dividing that total by 6 positions. This number is converted to the fraction entangled by dividing the product of 39 ends and 46½ inches minus the 1½ inches excluded from the entanglement measurement. This fraction is converted to percent by multiplying by 100. The effectiveness of the size is inversely related to the percentage of entanglement.

EXAMPLE 1

Samples of 25.5's 50/50 polyester/cotton yarn were dipped in a 5 percent solution of a 4:1 Saran:Styron 685 polystyrene blend in 1,1,1-trichloroethane using a laboratory slasher with a rubber-coated squeeze roll and a drying tube temperature of 105° C. After passing through the drying tube, the sized yarns were allowed to stand in air at room temperature overnight. Beam tension in grams was then measured on a Rothschild testing machine as the tension required to unwind the sized and dried yarn from a spool. Beam tension was measured a second time in the same way after the yarns had stood for an additional 45 days at room temperature.

TABLE I

| Resin | Beam Tension, grams | |
|---|---|---|
| | 1 day | 46 days |
| Saran[1] | 21 | 20 |
| Saran/Styron[2] | 13 | 11 |

[1]80/20 Vinyl chloride/vinylidene chloride copolymer.
[2]Molding grade of polystyrene, average molecular weight about 280,000.

EXAMPLE 2

Yarns of 25.5's 50/50 polyester/cotton blend were sized with starch (in aqueous emulsion), and with chlorinated polyethylene (CPE) and a 75/25 blend of chlorinated polyethylene with Styron 685 polystyrene respectively dissolved to 5 percent concentration in 1,1,1-trichloroethane. The solvent solutions also contained 5 percent stearic acid based on the weight of resin as a lubricant. Short (200-yard), narrow width weaving trials were run of the three sized yarns using a style 21 inches wide, 64 warp ends per inch by 100 fill ends per inch with a Draper pillow tubing loom at 185 picks per minute. The chlorinated polyethylene was a low crystallinity (<2 percent) material containing 48 percent chlorine. Results are listed in Table II.

TABLE II

| Size | % Add-on | Stops per 1,000 picks | Shedding grains/1000 picks |
|---|---|---|---|
| Starch | 23.6 | 0.044 | 1.16 |
| CPE | 6.0 | 0.051 | 1.50 |
| CPE/Styron 685 | 9.1 | 0.06 | 0.855 |

The last 100 yards of the weaving trial using the resin blend size showed much better performance as shown in Table III which breaks down the above data into 50-yard segments.

TABLE III

| Increment | No. stops | Shedding grains/1000 picks |
|---|---|---|
| 1st 50 yds | 22 | 0.879 |
| 2nd 50 yds | 18 | 0.913 |
| 3rd 50 yds | 0 | 0.847 |
| 4th 50 yds | 4 | 0.782 |

EXAMPLES 3–6

A slashing trial was run in a manner similar to that of Example 2 using a 424 end-section beam of yarn. The yarn was the same 50/50 polyester/cotton blend and it was sized in a pilot solvent slasher with 5 percent solutions in 1,1,1-trichloroethane of chlorinated polyethylene-Styron 685 mixtures containing various proportions of the polystyrene. Each solution also contained 5 percent stearic acid based on the weight of resin as a lubricant. The chlorinated polyethylene was that described in Example 2. The slasher was run at 27 yards/minute with a pad pressure of 30 psig and the size solution at ambient temperature (66°–76° F). The performance of the sized yarns was evaluated on the entanglement tester. Results are listed in Table IV. For purpose of comparison, the results of a test using the same yarn commercially sized with polyvinyl alcohol are also listed.

TABLE IV

| Size Resin % Polystyrene | Size Add-on | % Entanglement | | | |
|---|---|---|---|---|---|
| | | 5 min. | 10 min. | 20 min. | 40 min. |
| 10 | 12.37 | 1.27 | 1.46 | 0.66 | 0.97 |
| 15 | 9.87 | 0.95 | 0.9 | 1.54 | 0.11 |
| 25 | 13.1 | 0.49 | 0.41 | 0.74 | 0.77 |
| 40 | 12.45 | 1.13 | 2.6 | 3.38 | 0.58 |
| PVA | 10 | 0 | 0 | 1.4 | 1.0 |

With the yarns sized by the resin mixture, the packing tendency or tendency of the wound yarns to stick together improved with increasing proportion of polystyrene, the 40 percent mixture being comparable to PVA. However, most of the improvement in this respect had been obtained when the proportion of polystyrene reached 25 percent. Also, as shown by the above data, the entanglement performance was much better at 25 percent than it was at 40 percent polystyrene.

EXAMPLE 7

A solution of 5 percent 4:1 chlorinated polyethylene:Styron 685 polystyrene in 1,1,1-trichloroethane containing 5 percent stearic acid on total resin as lubricant was used as described in Examples 3–6 to size 25.5's 50/50 polyester/cotton blend yarns which were then woven into about 1,000 yards of full width fabric. The fabric was then desized by passing it through a soak tank containing 1,1,1-trichloroethane, soak time 15 minutes, to a wash box of fresh solvent with a final spray rinse and a set of nip rolls to the drier. Better than 90 percent of the resin size was removed from the fabric by this process.

The desizing solvent thereby obtained was evaporated to 5 percent resin content and this solution was reused in the same way for sizing the same kind of yarn. Weaving performances of yarns originally sized with fresh size solution in the 1000 yard trial described above and in a similar 200 yard trial (Example 2) are compared with that of the yarns sized with recovered size solution in Table V.

TABLE V

| Size | Add-on % | Stops per 1,000 picks | Shedding grains/1000 picks |
|---|---|---|---|
| fresh size (200 yd trial) | 9.1 | 0.06 | .855 |
| fresh size (1000 yd trial) | 11.0 | 0.06 | — |
| recycled size (from desize of 1000 yd trial) | 8.4 | 0.018 | 1.01 |

Warp stop performance of recycled size was superior while shedding was similar to that found with fresh size solutions.

I claim:

1. In a resin composition for sizing textile yarns, the improvement wherein said resin composition is a mixture of a chlorinated polyolefin having a crystallinity of less than about 10 percent and about 10–50 percent based on the weight of chlorinated polyolefin of an aromatic hydrocarbon polymer having an average molecular weight of at least about 100,000.

2. The composition of claim 1 wherein the aromatic hydrocarbon polymer is polystyrene.

3. The composition of claim 2 wherein the chlorinated polyolefin is chlorinated polyethylene.

4. The composition of claim 2 wherein the chlorinated polyolefin is a copolymer of vinyl chloride and vinylidene chloride.

5. In the process for sizing a textile material with a chlorinated lower aliphatic hydrocarbon solvent solution of a resin, the improvement wherein said resin is the mixture of claim 1.

6. The process of claim 5 wherein the resin is a mixture of chlorinated polyethylene having a crystallinity of less than about 10 percent and about 10–50 percent based on the weight of chlorinated polyethylene of polystyrene having an average molecular weight of at least about 100,000.

7. The process of claim 5 wherein the resin is a mixture of a copolymer of vinyl chloride and vinylidene chloride having a crystallinity of less than about 10 percent and about 10–50 percent based on the weight of said copolymer of polystyrene having an average molecular weight of at least about 100,000.

8. In a textile yarn sized with a resin composition, the improvement wherein the resin composition is the mixture of claim 1.

9. The sized yarn of claim 8 wherein the sizing resin is a mixture of chlorinated polyethylene having a crystallinity of less than about 10 percent and about 10–50 percent based on the weight of chlorinated polyethylene of polystyrene having an average molecular weight of at least about 100,000.

10. The sized yarn of claim 9 wherein the yarn is a cotton-polyester blend.

* * * * *

UNITED STATES PATENT AND TRADEMARK OFFICE

CERTIFICATE OF CORRECTION

PATENT NO. : 4,076,629

DATED : February 28, 1978

INVENTOR(S) : Gerald P. Beaumont; William C. Jones

It is certified that error appears in the above-identified patent and that said Letters Patent are hereby corrected as shown below:

Column 2, line 42, change the word "any" to -- and --.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*